US009115559B2

(12) United States Patent
Al-Anazi

(10) Patent No.: US 9,115,559 B2
(45) Date of Patent: Aug. 25, 2015

(54) INFLATABLE COLLAR AND DOWNHOLE METHOD FOR MOVING A COILED TUBING STRING

(71) Applicant: Saudi Arabian Oil Company, Dhahran (SA)

(72) Inventor: Hamoud Ali Al-Anazi, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 111 days.

(21) Appl. No.: 13/800,336

(22) Filed: Mar. 13, 2013

(65) Prior Publication Data

US 2013/0248187 A1 Sep. 26, 2013

Related U.S. Application Data

(60) Provisional application No. 61/613,571, filed on Mar. 21, 2012.

(51) Int. Cl.

| | |
|---|---|
| ***E21B 23/14*** | (2006.01) |
| ***E21B 31/03*** | (2006.01) |
| ***E21B 33/138*** | (2006.01) |
| ***E21B 23/08*** | (2006.01) |
| *E21B 33/124* | (2006.01) |

(Continued)

(52) U.S. Cl.

CPC ..... *E21B 23/14* (2013.01); *E21B 23/08* (2013.01); *E21B 31/03* (2013.01); *E21B 33/127* (2013.01); *E21B 33/138* (2013.01); *E21B 23/06* (2013.01); *E21B 33/1243* (2013.01); *E21B 33/1277* (2013.01)

(58) Field of Classification Search

CPC ..... E21B 33/127; E21B 33/1272; E21B 33/1277; E21B 33/134; E21B 33/1243; E21B 23/06; E21B 43/00

USPC ..... 166/187, 387, 369

See application file for complete search history.

(56) References Cited

U.S. PATENT DOCUMENTS

| | | | |
|---|---|---|---|
| 3,050,130 | A | 8/1962 | Culver et al. |
| 3,052,302 | A | 9/1962 | Lagucki |

(Continued)

FOREIGN PATENT DOCUMENTS

| | | |
|---|---|---|
| GB | 2357787 | 7/2001 |

OTHER PUBLICATIONS

International Search Report and Written Opinion dated Sep. 2, 2014 from PCT application No. PCT/US2013/030741.

*Primary Examiner* — Nicole Coy

(74) *Attorney, Agent, or Firm* — Abelman, Frayne & Schwab

(57) ABSTRACT

An elongated inflatable collar is securely attached to the exterior surface of a coiled tubing string before the tubing is lowered into the well for subsequent positioning at a predetermined subterranean location in the well casing. Upon inflation, the inflatable collar seals the annulus between the coiled tubing string and the well casing. A liquid injected from the surface creates sufficient hydraulic pressure on the upper surface of the inflated collar to advance the collar and the attached coiled tubing string and overcome frictional drag forces with the surrounding wall that caused the coiled tubing string to lock-up. The inflatable collar of the present invention can also be used to free a section of coiled tubing that is jammed in the formation due to buckling, by injecting a pressurized liquid into the wellbore downstream of the inflated collar to thereby apply a force to the downhole surface of the collar.

15 Claims, 8 Drawing Sheets

(51) Int. Cl.
*E21B 33/127* (2006.01)
*E21B 23/06* (2006.01)

(56) References Cited

U.S. PATENT DOCUMENTS

| | | | |
|---|---|---|---|
| 3,506,068 | A | 4/1970 | Brown et al. |
| 4,378,051 | A | 3/1983 | Cholet et al. |
| 4,714,117 | A | 12/1987 | Dech |
| 4,823,882 | A | 4/1989 | Stokley et al. |
| 4,869,324 | A | 9/1989 | Holder |
| 5,249,625 | A | 10/1993 | Skipper et al. |
| 5,435,392 | A | 7/1995 | Kennedy |
| 6,236,620 | B1 | 5/2001 | Schultz et al. |
| 6,966,386 | B2 | 11/2005 | Ringgenberg et al. |
| 7,048,066 | B2 | 5/2006 | Ringgenberg et al. |
| 7,059,417 | B2 | 6/2006 | Moore et al. |
| 7,096,976 | B2 | 8/2006 | Paluch et al. |
| 7,191,844 | B2 | 3/2007 | Kenison et al. |
| 7,434,616 | B2 | 10/2008 | Echols |
| 7,798,225 | B2 | 9/2010 | Giroux et al. |
| 2009/0101334 | A1 | 4/2009 | Baser et al. |
| 2011/0266004 | A1* | 11/2011 | Hallundbaek et al. ..... 166/369 |

* cited by examiner

INFLATABLE COLLAR AND DOWNHOLE METHOD FOR MOVING A COILED TUBING STRING

CROSS REFERENCE TO RELATED APPLICATION

This application claims the benefit of U.S. Provisional Application No. 61/613,571, filed Mar. 21, 2012, which is hereby incorporated by reference.

FIELD OF THE INVENTION

The present invention relates to methods and apparatus employed downhole to move a coiled tubing string that has become immobilized due to buckling, lock-up and/or high frictional forces at the downhole end of the tubing.

BACKGROUND OF THE INVENTION

A coiled tubing unit ("CTU") is commonly used to perform well intervention and stimulation operations in gas and oil wells. A CTU includes a coiled tubing reel to store and transport the coiled tubing string and a specially outfitted truck to perform the installation. A common application uses coiled tubing to withdraw produced hydrocarbons from open-hole horizontal wells that have no casing. In horizontal wells with maximum reach, also referred to as "extended reach wells", a coiled tubing string may not be able to reach total depth (TD) due to buckling, lock-up and drag/friction between the flexed tubing and the formation while running in the open-hole section of the wellbore. Installation of coiled tubing requires the truck, or rig, to remain on location which is very costly. Rigless operations cannot achieve total depth and are therefore unsuccessful with results being below expectation. This limitation can result in inefficient operations and treatment due to the inability to access sections of the well. A coiled tubing string can also become stuck in the hole, so that the only option for continuing is to cut part of the coiled tubing string and fish it out of the hole.

Prior art methods for assisting movement of a coiled tubing string under different formation conditions include applying chemical friction modifiers to the tubing and tractors both of which work only in certain operational windows. Each method also has some limitations due to the magnitude of the frictional drag forces and the total depth to be achieved. Tractors require additional drive to increase pulling of the coiled tubing string and to reach greater depths. These methods are generally not applicable in open-hole horizontal well installations.

The present invention is directed to providing solutions to the problems associated with running a coiled tubing string in extended reach horizontal open-hole wells and specifically to the problems of buckling, lock-up and frictional drag forces that slow or even prevent the completion of the coiled tubing installation and/or its removal. The terms "coiled tubing" and "coiled tubing string" are used interchangeably in the specification and claims.

SUMMARY OF THE INVENTION

In accordance with the methods and apparatus of the present invention, an inflatable collar is securely attached at a predetermined position on the coiled tubing string. The inflatable collar is installed at the surface in anticipation of potential buckling and lock-up as described above as part of the CTU assembly before running the coiled tubing into the wells. Upon its inflation with a liquid or pressurized gas, e.g., air, the inflatable collar expands to seal the annulus between the coiled tubing string and production tubing. The collar can be inflated through an internal port/valve/actuator that is activated by injected fluid to open and allow the fluid to pressurize the collar and cause it to inflate. The port can be similar to the commercially available circulation valves that are activated by a pressure increase inside the coiled tubing string to inflate the collar. See, for example, the OMNI™ DT circulating valve, which is described at: http://www.halliburton.com/public/ts/contents/Data_Sheets/web/H/H07826.pdf, the contents of which are incorporated herein by reference. The OMNI™ DT circulating valve can be used as a circulation valve for inflating the collar. In addition, the inflation valves of the present invention, as described below, can also be made part of the inflatable collar assembly. After the collar is inflated around the coiled tubing and the inlet valve is closed, a pressurized liquid, such as water, diesel or reservoir fluids, are injected from the wellhead or surface using a pump to apply a hydrodynamic force to the upper surface, or uphole-side, of the inflated collar to overcome the frictional drag that caused the coiled tubing string to lock-up and thereby advance the collar and coiled tubing string further into the well bore.

The inflatable collar and the method of the present invention can also be used to free a stuck section of the coiled tubing string by applying the pressurized liquid to the lower or downhole surface of the collar to move the string back up the wellbore towards the surface and thereby withdraw the distal end portion. This method can avoid the need for cutting and fishing operations which add more to the time and costs for completion.

After the collar and tubing have been advanced to the desired position, deflation can be initiated by the use of a rupture disc or a relief valve. The collar can also be deflated by the external pressure of well fluids that are higher than the inflated pressure.

In another embodiment, the deflated inflatable collar is attached to the coiled tubing and lowered to predetermined position inside of the perforated casing that is at the location of an oil/water interface in preparation for a water shut-off treatment. Following inflation of the collar to seal the annulus and protect the oil producing zone, the water shut-off treatment is introduced via the coiled tubing. Following completion of the water shut-off treatment, the collar can be deflated and withdrawn with the coiled tubing.

BRIEF DESCRIPTION OF THE DRAWINGS

The invention will be described in further detail below and with reference to the attached drawings in which the same or similar elements are referred to by the same number and where.

DETAILED DESCRIPTION OF THE INVENTION

Figure 1:
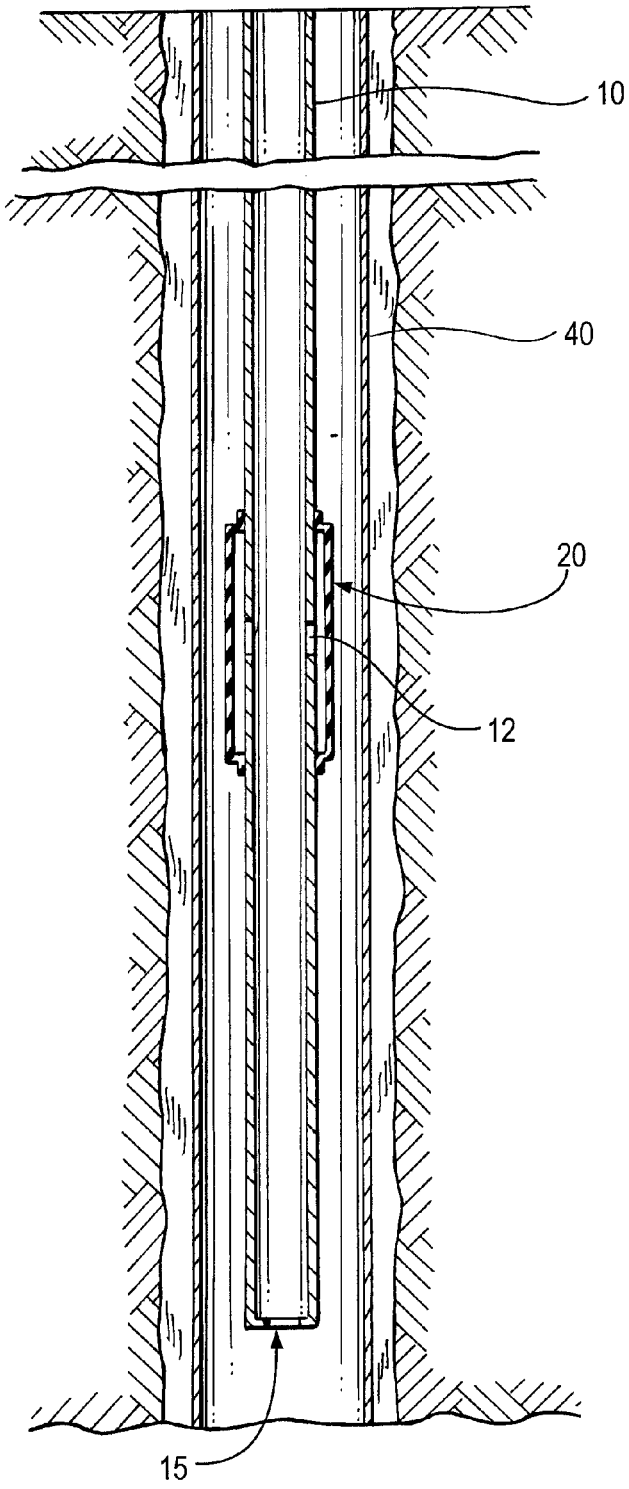
FIG. 1 is a cross-sectional side view of an inflatable collar of the present invention attached to a perforated section of a coiled tubing string prior to being inflated.

Referring to FIG. 1, an inflatable collar 20 of the present invention is shown securely attached to a section of a coiled tubing string 10 in a deflated condition. The collar can be connected to the coiled tubing string through integral parts, threads, or a tool joint at the surface. It can be connected with treaded connection or a make-up tool. In another embodiment, it can be connected by using a slot or notch on either side of the coiled tubing string.

The inflatable collar can be manufactured from heavy duty rubber or other elastomers such as synthetic rubber or polymeric materials of the types used to make mechanical packers. It can also be reinforced with fibers and/or metal. The thickness of the material depends on the expected pressure differential in the well. The thicknesses is selected to withstand the pressures that are expected in the well. The nominal outside diameter of the deflated collar 20 is smaller than the well tubing or casing 40 that the coiled tubing string 10 will be run through so that it can be lowered into a desired position without interference or significant frictional drag forces.

Figure 2:
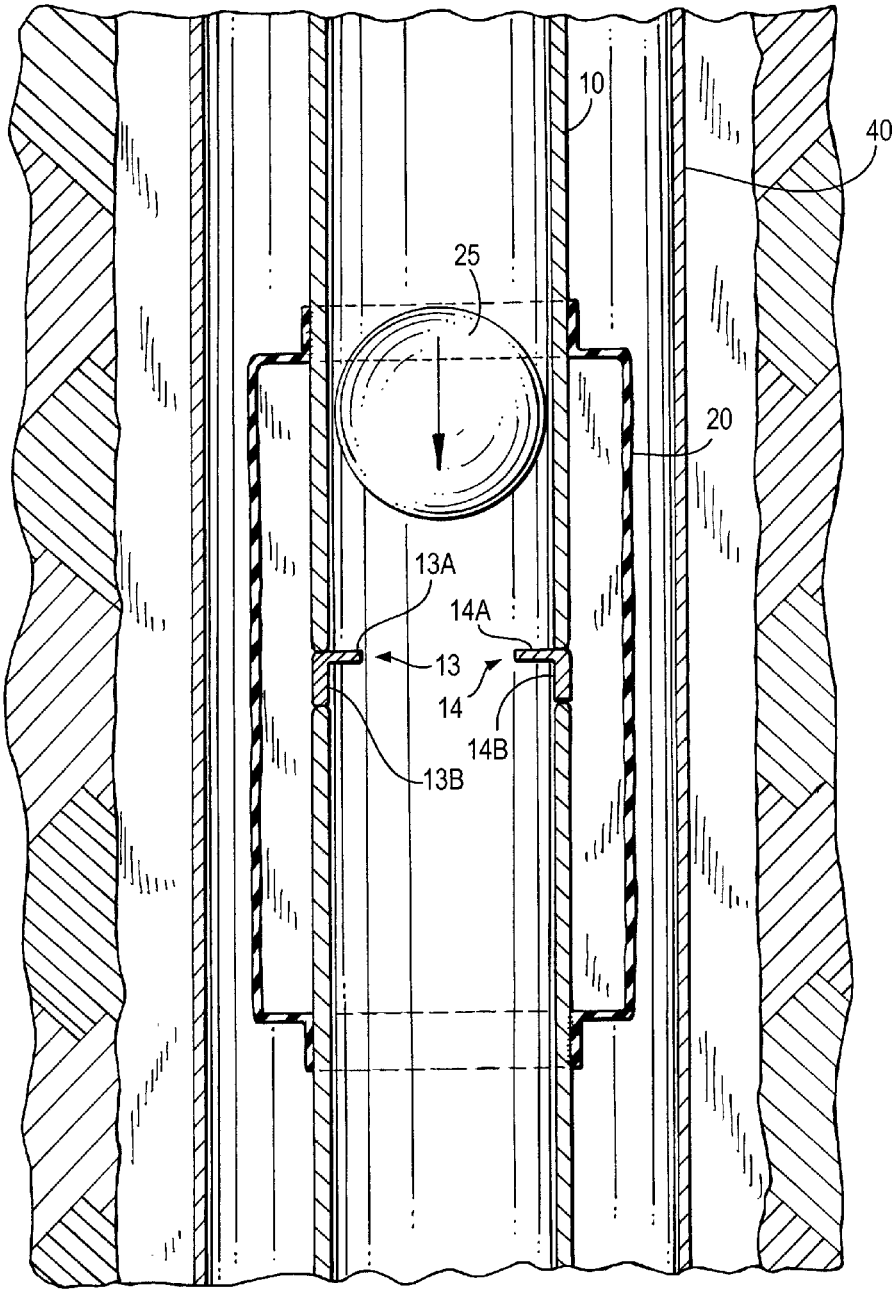
FIG. 2 shows the inflation valves in a closed position prior to inflation of the inflatable collar.
Figure 3:
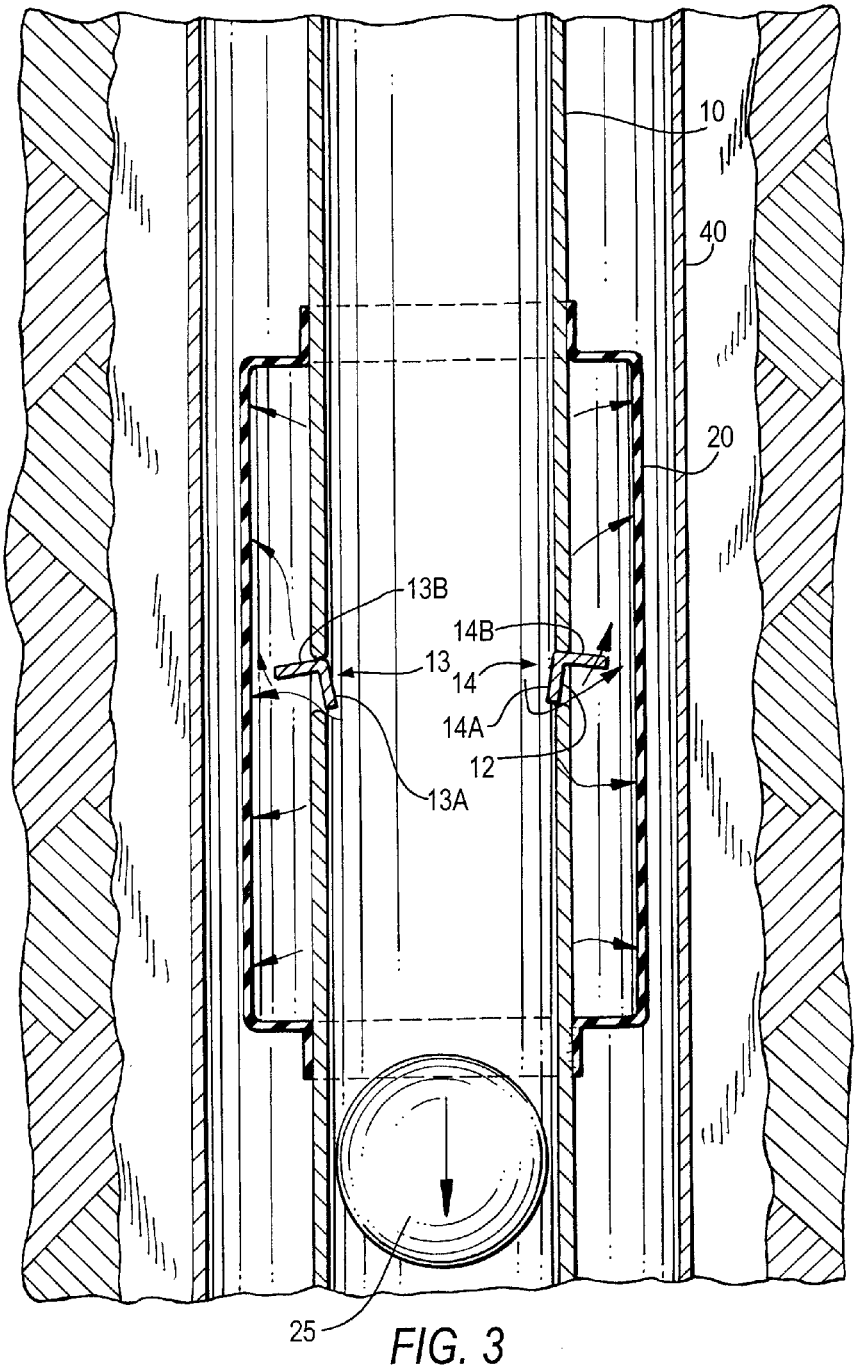
FIG. 3 shows the inflation valves in an open position with partial inflation of the inflatable collar.
Figure 4:
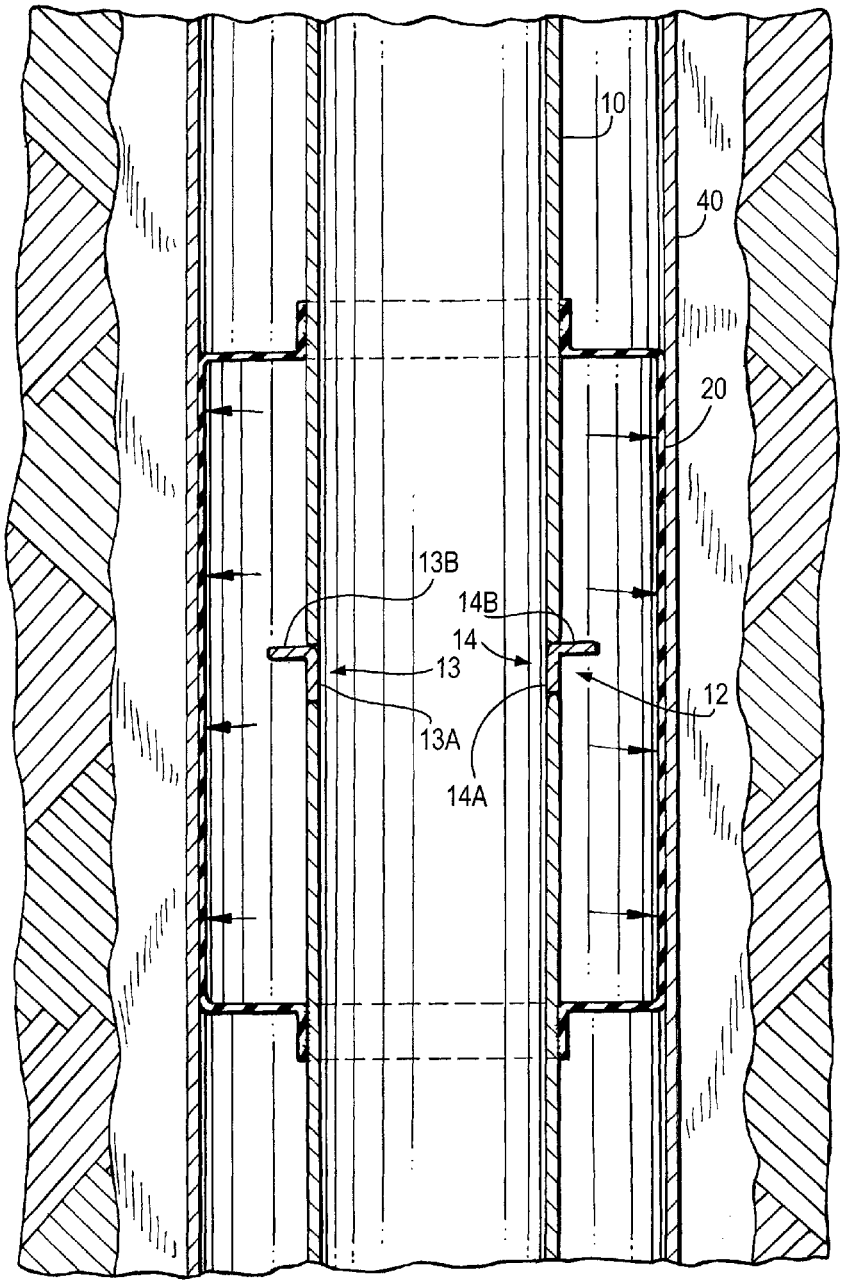
FIG. 4 shows the inflation valves in a closed position after inflation of the inflatable collar.

Referring now to the embodiment shown in FIGS. 2-4, a pair of inflation valves 13, 14 are installed within the perforations 12 in the wall of the coiled tubing string 10 for controlling the opening and closing of the perforations. Although only two inflation valves are illustrated in the example, the number of inflation valves can be any number, such as one, two, three, or more. Preferably, at least two inflation valves are utilized in case one of the valves encounters a mechanical failure or becomes blocked by debris. The inflation valves are L-shaped and include a first leg portion 13A, 14A and a second leg portion 13B, 14B. Each inflation valve is rotatable about a pin or other pivot device. In FIG. 2, the inflation valves 13, 14 are in a closed position prior to inflation of the inflatable collar 20, in which the second leg portions 13B, 14B seal the perforations 12. The collar 20 is inflated by passing a pressurized fluid, e.g., a liquid through perforations 12 formed in the wall of the coiled tubing string 10 that are in fluid communication with the interior of the collar. A sealer ball 25 is shown positioned above the inflation valves 13, 14. In FIG. 3, the sealer ball 25 is advanced downstream and passes by the inflation valves 13, 14. The sealer ball 25 has a predetermined diameter such that as it passes by the inflation valves 13, 14, it activates the valves by pushing against the first leg portions 13A, 14A which rotates the valves. This in turn opens the perforations 12 and allows the injected fluid to pressurize the inflatable collar 20. In FIG. 4, the valves are shown in a closed position whereby the first leg portions 13A, 14A seal the perforation 12 to return the pressurized fluid inside the inflatable collar 20. The valves will close by the pressure of the injected fluid that inflates the collar. The valve will close at a predetermined pressure that is higher than that needed to pressurize the collar. In other words, it acts as a pressure-controlled valve; it opens and closes in response to the change in the pressure of the injected fluid.

Figure 5:
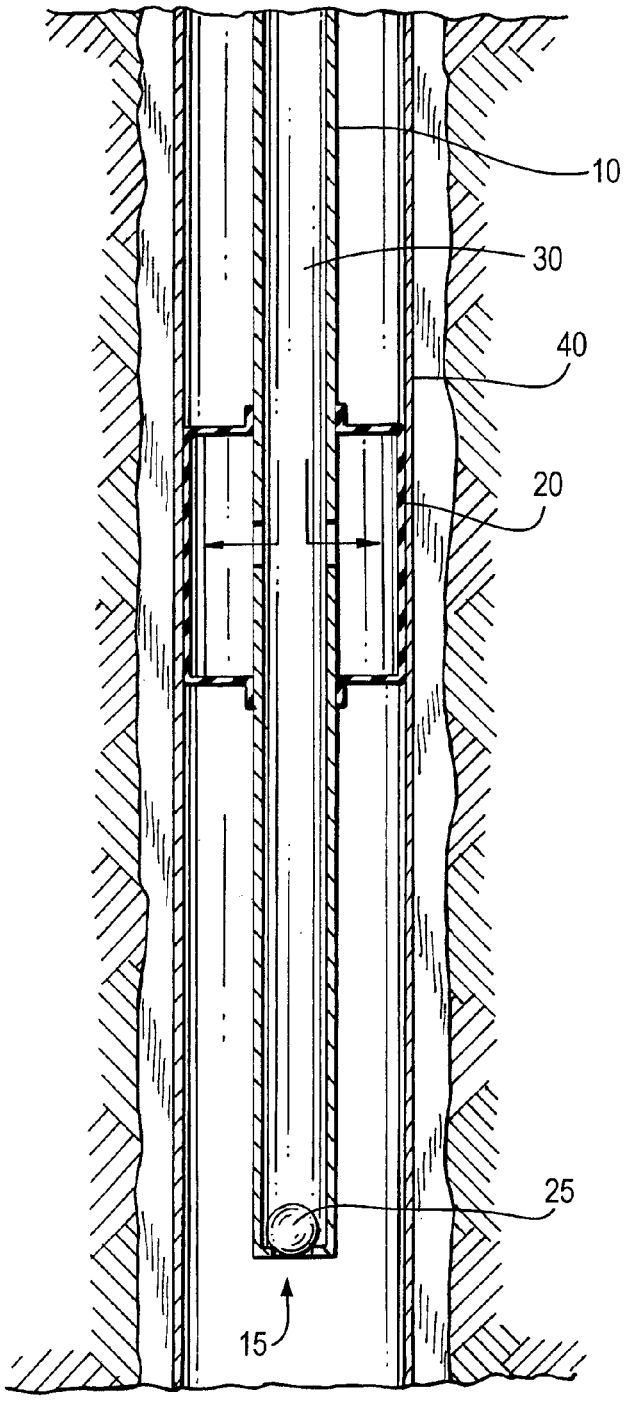
FIG. 5 shows the inflatable collar of FIG. 1 after its inflation.

Referring now to FIG. 5, the inflatable collar is shown in its inflated configuration. The inflatable collar 20 can be inflated by dropping a sealer ball 25 from the surface to seal the opening of the coiled tubing string nozzle 15. A portion of the coiled tubing below the inflatable collar assembly has a smaller diameter such that the sealer ball is stopped by the smaller diameter of tubing and seals the distal opening of the coiled tubing string nozzle. This seal allows a hydraulic fluid 30, e.g., water or diesel, to be pumped into the tubing and passed through perforations 12 in the coiled tubing 10 to inflate the collar 20. In the illustrated embodiment, the inflated collar 20 is cylindrically-shaped. However, the inflatable collar can include other shapes, such as spherical or elliptical. The inflation pressure is sufficient to inflate collar 20 to seal the annulus between the coiled tubing string and production tubing.

Figure 6:
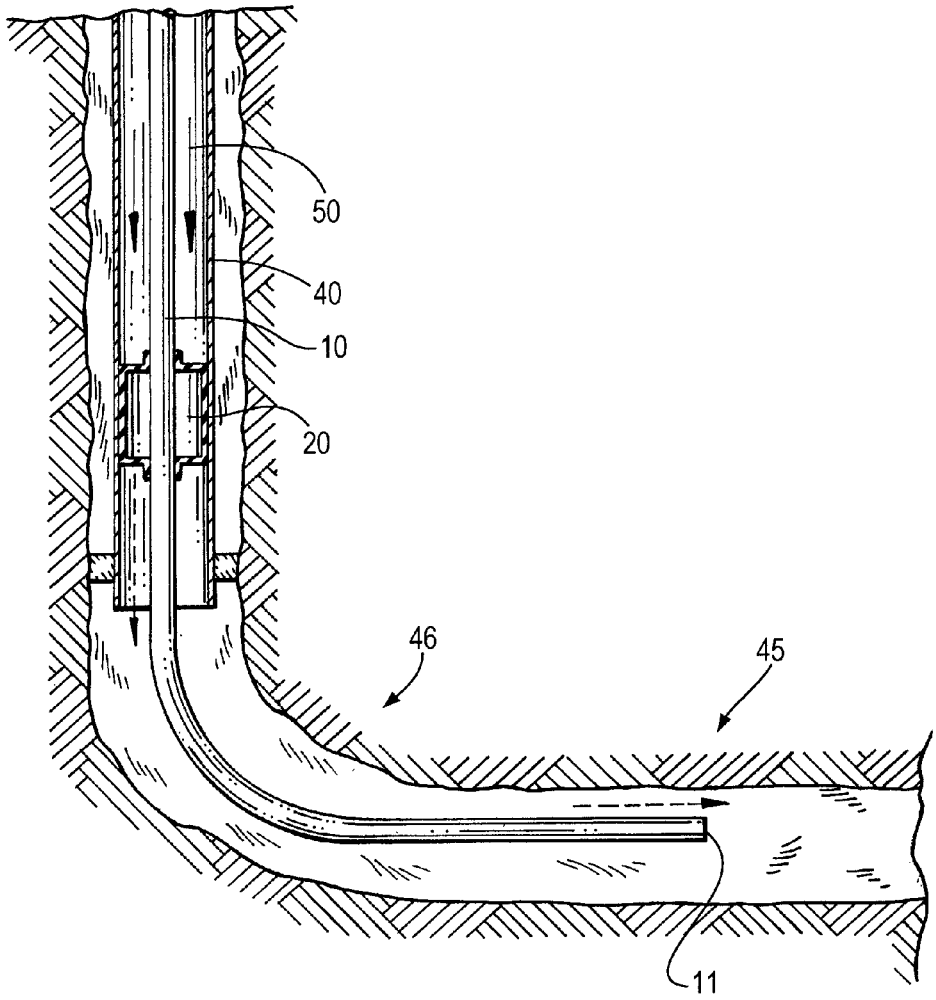
FIG. 6 is a side view, partly in cross-section, in which the collar is inflated and is positioned within the casing upstream of a section of a horizontal wellbore.

As shown in FIG. 6, the collar has been inflated by, e.g., hydraulic fluid as discussed above, and is positioned in the tubing upstream of the heel 46 of a horizontal wellbore 45. The end of the coiled tubing string 11 is positioned in the open-hole portion of the horizontal wellbore 45. When liquid 50 is pumped into the annulus between the well's tubing or casing 40 and the coiled tubing string 10, the fluid 50 applies a hydraulic force to the upper surface of the inflated collar 20. This force acts to advance the collar and, thereby the distal end of the coiled tubing string 11 into the horizontal wellbore 45 to reach maximum depth, and to overcome frictional forces that might otherwise prevent advancement of the coiled tubing string. The inflated collar also serves to center the coiled tubing 10 in the tubing 40. The pressure of the injected fluid 50 can be easily controlled by the operator from the earth's surface. It will also be understood from FIG. 6 that the inflatable collar 20 can be advanced to the end of the casing or production tubing 40 while maintaining the hydraulic pressure of the head of liquid 50.

Figure 7:
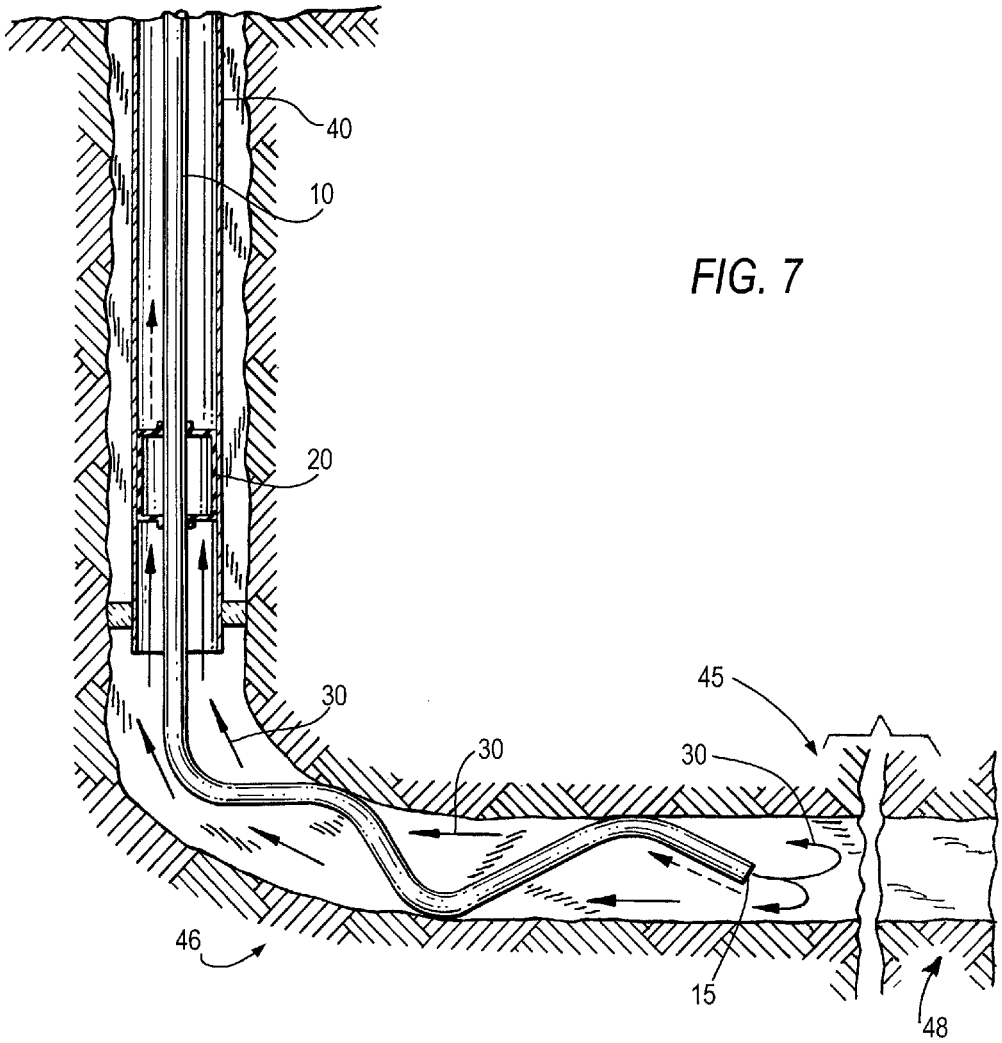
FIG. 7 is a side view, partly in cross-section, showing an inflated collar positioned within the casing upstream of a horizontal open-hole wellbore and functioning to a free a buckled and locked up section of the coiled tubing string.

FIG. 7 schematically illustrates an open-hole well similar to FIG. 6, but in which the end portion of the coiled tubing string 10 has buckled and is locked up to such an extent that it cannot advance further into the open hole. As shown, the inflatable collar 20 is positioned in the tubing 40 for the purpose of freeing the coiled tubing string 10 which has become stuck in a horizontal wellbore 45 to avoid the cutting and fishing operations which would otherwise be required. In case the coiled tubing string 10 becomes stuck due to buckling or friction in a long horizontal wellbore 45, a fluid or lubricant 30 can be injected through the coiled tubing nozzle 15. As shown in FIG. 7, the pressurized injected fluid 30 will apply a hydraulic force on the lower surface of the inflated collar 20 to move the assembly up tubing 40 and assist in retracting the tubing 10 thereby enabling the coiled tubing string 10 to be pulled from the earth's surface using a tractive force that is within the string's tension limit.

Figure 8:
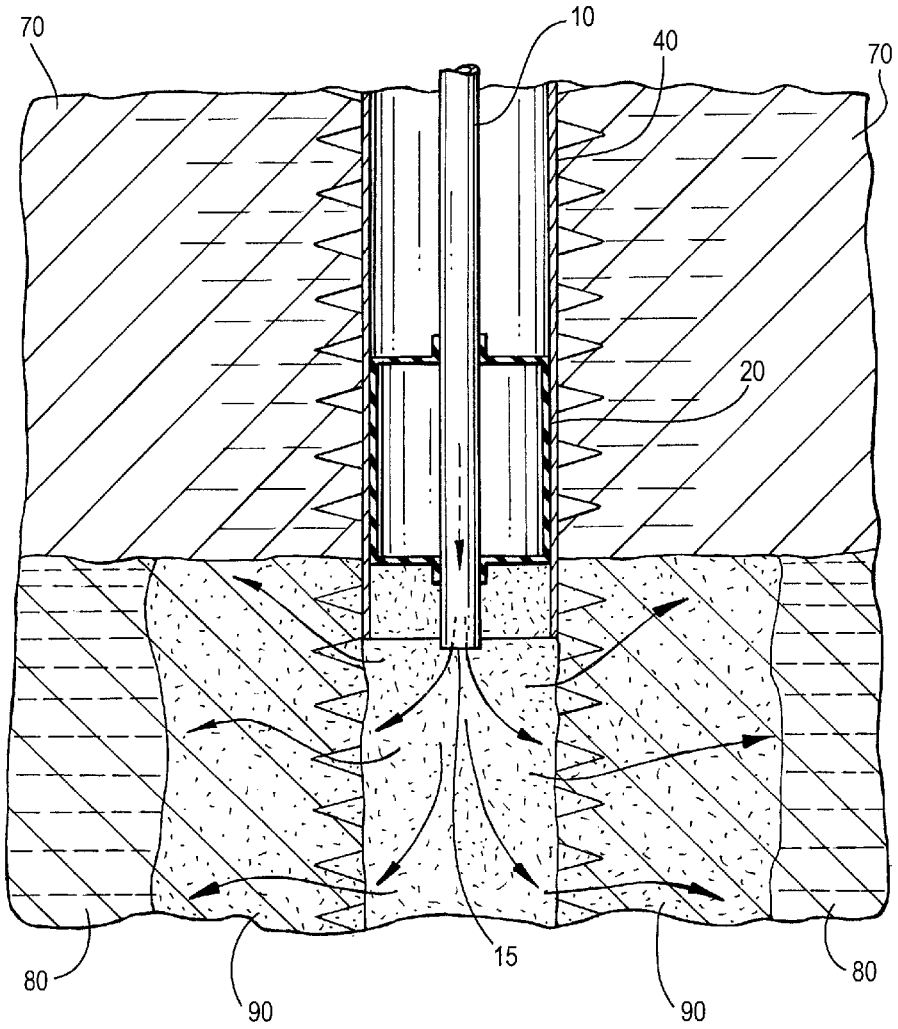
FIG. 8 is a side view, partly in cross-section, showing an inflated collar positioned within an oil production zone for sealing a water zone.

Another embodiment of the method of the present invention is schematically shown in FIG. 8 in which the inflated collar is positioned between an oil-producing zone 70 and a water producing zone 80. The inflatable collar 20 can be used with a coiled tubing string 10 to isolate the production tubing or liner between predetermined zones that need to be protected while doing an injection treatment on the zone below. In the illustrated example, a water shut-off treatment 90, e.g., using either a cement slurry or gelled polymer solution, is used to seal a water producing zone 80, which is located below the oil producing zone 70. The inflatable collar 20 is used to temporarily isolate the oil zone 70 while the sealing treatment 90 is pumped through the inside of the coiled tubing string 10. The sealing treatment 90 then exits from the nozzle 15 and is discharged into the perforated casing 40 into the water zone where it solidifies and shuts off the flow of water into the casing from zone 80. After pumping the sealing treatment 90, the collar 20 is deflated and the coiled tubing string 10 is withdrawn from the hole. After the water zone has been sealed by this method, the well will produce only from the oil producing zone 70 without the undesirable water production from the water zone 80 below.

In the illustrated embodiments, a single inflatable collar is attached to the coiled tubing string. In other embodiments and especially when used in deep wells, multiple inflatable collars can be attached to the coiled tubing string at a plurality of predetermined locations. The inflatable collar of the present invention can be applied in both open and cased hole wells.

It will thus be seen from the preceding that the problems set forth above are solved in a particularly effective, simple, and inexpensive way, with a considerable advantage to the user.

The above disclosure is intended to be illustrative and not exhaustive. This description will suggest many modifications, variations, and alternatives that may be made by those of ordinary skill in this art without departing from the scope of the invention. Those familiar with the art may recognize other equivalents to the specific embodiments described above. Accordingly, the scope of the invention is not limited to the foregoing specification and attached drawings.

What is claimed is:

1. A method for moving a coiled tubing string relative to a well casing in which the coiled tubing string is to be positioned, the method comprising:

a. securing an inflatable collar to the coiled tubing string at a predetermined position on the coiled tubing string at which position the wall of the tubing is perforated to permit passage of a fluid;

b. positioning the coiled tubing string and inflatable collar in the well casing;

c. pumping a pressurized fluid into the coiled tubing string for passage through the tubing perforations to inflate the collar and form a fluid-tight seal between an interior wall of the well casing and the coiled tubing string;

d. injecting a pressurized liquid into an annulus between the well casing and the coiled tubing string to contact and apply in a direction a force to a surface of the inflated collar that is sufficient to move the inflated collar and attached coiled tubing string relative to the well casing in the direction of the applied force.

2. A method for freeing a locked-up coiled tubing string in a well casing comprising:

a. securing an inflatable collar to the coiled tubing string at a predetermined position that is displaced from the downhole end of the tubing and at which position the wall of the tubing is perforated to permit passage of a fluid;

b. lowering the coiled tubing string and inflatable collar into the well casing;

c. pumping a pressurized fluid into the locked-up coiled tubing string for passage through the tubing perforations to inflate the collar and form a fluid-tight seal between the well casing and the coiled tubing string;

d. injecting a pressurized liquid through the locked-up coiled tubing string and discharging the liquid from the open downhole end of the locked-up coiled tubing string to fill and pressurize the wellbore and an annulus between the well casing and the coiled tubing string to contact and apply in a direction a force to a downhole surface of the inflated collar that is sufficient to move the inflated collar and attached coiled tubing string relative to the well casing in the direction of the applied force.

3. A method of isolating a section of perforated well casing between an oil-producing zone and a water-producing zone during a water shut-off treatment which includes:

a. securing an inflatable collar to a coiled tubing string at a predetermined position corresponding to a depth of an interface between the oil- and water-producing zones at which position the wall of the tubing is perforated to permit passage of a fluid;

b. lowering the coiled tubing string to position the inflatable collar at the depth corresponding to the interface;

c. pumping a pressurized fluid into the coiled tubing string for passage through the tubing perforations to inflate the collar and form a fluid-tight seal between the perforated well casing and the coiled tubing string;

d. injecting a water shut-off composition via the coiled tubing string into a region surrounding the coiled tubing string to seal the water-producing zone; and e. producing oil into the perforated well casing above the sealed portion of the perforated well casing sealed by the inflated collar.

4. An inflatable collar assembly for moving a coiled tubing string relative to a well casing in which the coiled tubing string is positioned, the inflatable collar assembly comprising:

a. an inflatable collar secured to an exterior surface of the coiled tubing string at a predetermined position, such that the inflatable collar surrounds at least one perforation in a wall of the coiled tubing string; and b. at least one valve positioned within the at least one perforation in the wall of the coiled tubing string, wherein the at least one valve is movable between a closed position and an open position, wherein a pressurized fluid pumped into the coiled tubing string when the at least one valve is in the open position will pass through the at least one perforation and inflate the collar and seal an annular space between the coiled tubing string and the well casing.

5. The inflatable collar assembly of claim 4, wherein the at least one valve is L-shaped and comprises first and second leg portions.

6. The inflatable collar assembly of claim 5, further comprising a pivot device for operatively securing the at least one valve in the at least one perforation in the wall of the coiled tubing string for movement from the closed position to the open position.

7. The inflatable collar assembly of claim 4, wherein the at least one valve is a pressure-controlled valve that opens and closes in response to a predetermined change in a pressure of the fluid in the coiled tubing string.

8. The inflatable collar assembly of claim 4, wherein the at least one valve comprises two valves.

9. The inflatable collar assembly of claim 4, further comprising:

a. a sealer ball; and b. an opening at a distal end of the coiled tubing string;

wherein the sealer ball is adapted to pass through a length of the coiled tubing string and into contact with the opening at the distal end of the coiled tubing string.

10. The inflatable collar assembly of claim 9, wherein the sealer ball has a predetermined diameter such that it contacts the at least one valve as the sealer ball passes by the at least one valve while moving from a proximal end to the distal end of the coiled tubing string.

11. The inflatable collar assembly of claim 4, wherein the inflatable collar is cylindrically-shaped.

12. The inflatable collar assembly of claim 4, wherein the inflatable collar is spherical.

13. The inflatable collar assembly of claim 4, wherein the inflatable collar is elliptical.

14. The inflatable collar assembly of claim 4, wherein the inflatable collar comprises an elastomeric material.

15. The inflatable collar assembly of claim 14, wherein the elastomeric material is fiber reinforced.

* * * * *